United States Patent [19]

Liu et al.

[11] 4,055,864

[45] Nov. 1, 1977

[54] AUTOMATIC LID-LIFTING AND FLUSHING DEVICE FOR WATER CLOSET

[76] Inventors: Yu-Hsing Liu, No.7-3, Alley 15, Lane 667, Chung Shan Road, Sec. 2, Chung Ho, Taipei Hsien; Fon-Wen Chiu, 11th Floor, No. 220, Sung Chiang Road, Taipei, both of China /Taiwan

[21] Appl. No.: 695,786

[22] Filed: June 14, 1976

[51] Int. Cl.[2] ..... A47K 13/00

[52] U.S. Cl. ..... 4/253; 4/DIG. 3

[58] Field of Search ..... 4/54, 64, DIG. 3, 21, 4/24, 253, 249, 67, 100; 160/1

[56] References Cited

U.S. PATENT DOCUMENTS

| | | | |
|---|---|---|---|
| 3,024,469 | 3/1962 | Lewis et al. | 4/DIG. 3 |
| 3,048,854 | 8/1962 | Miller | 4/253 |
| 3,590,397 | 7/1971 | Akamatsu et al. | 4/249 X |
| 3,621,495 | 11/1971 | Carson | 4/DIG. 3 |
| 3,965,492 | 6/1976 | Hendricks | 4/DIG. 3 |

*Primary Examiner*—Leonard H. Gerin

*Attorney, Agent, or Firm*—Burns, Doane, Swecker & Mathis

[57] ABSTRACT

A device for automatically controlling the lid and seat of a water closet, and the flushing operation. The device includes an electric circuit which activates a mechanical system for opening and closing the lid, or both the lid and the seat. The system includes a mechanism for automatically flushing the water closet when the lid is being closed.

11 Claims, 13 Drawing Figures

(A)

(B)

(C)

(D)

AUTOMATIC LID-LIFTING AND FLUSHING DEVICE FOR WATER CLOSET

FIELD OF INVENTION

The present invention relates generally to automatic lid-lifting and flushing device for a water closet and more particularly to such device adapted to be used in existing water closets and comprising a control circuit, through a motor, transmission gear and cam means, incorporated with a link and pull string, to open or close the lid and/or the seat ring of the water closet, and to flush the closet automatically after the lid being closed.

BACKGROUND OF INVENTION

In using a conventional water closet, the user has to lift the lid and/or seat ring by hand and, after use, to return these parts to the closed condition by hand, then press the flush water handle. This is an unpleasant job which needs several steps of operation, and bending or bowing positions right have to be assumed.

In many situations, no urinal is provided so, man has to use the water closet for urinating. Many people neglect to have the seat ring lifted, so stains of urine, are left on the seat ring, which causes the later user to clean the seat ring before use.

The content of the water closet gives bad odor; after using the user has to close the lid by hand, then flush it. Sometimes due to the unpleasent feeling, the user would purposely neglect to close the lid.

To eliminate the hand operation, many devices, most of which being mechanically operated, have been disclosed. However, the inconvenience in operation, i.e. usually the lid lifting and closing operation are not incorporated with water flushing, makes the device impractical.

SUMMARY OF INVENTION

Therefore, the main object of the present invention is to provide an electrically operated automatic lid-lifting and flushing device for a water closet. With only a press for a button, either with hand or foot, the selective operation of lifting or closing of the lid, with or without seat ring, would be completed, and after the lid being closed, the flush of water would automatically follow.

Another object of the present invention is to provide an automatic lid-lifting and flushing device which can be adapted to be used in the existing water closet and sold as an individual commodity item.

Still another object of the present invention is to provide an electrically operated lid-lifting and flashing device, the functions of which are achieved simply by pressing a button.

Other objects and feature of the present invention will become clear by way of the following detailed description to be taken in conjunction with the annexed drawings.

DETAIL DESCRIPTION OF PREFERRED EMBODIMENT

Figure 1:
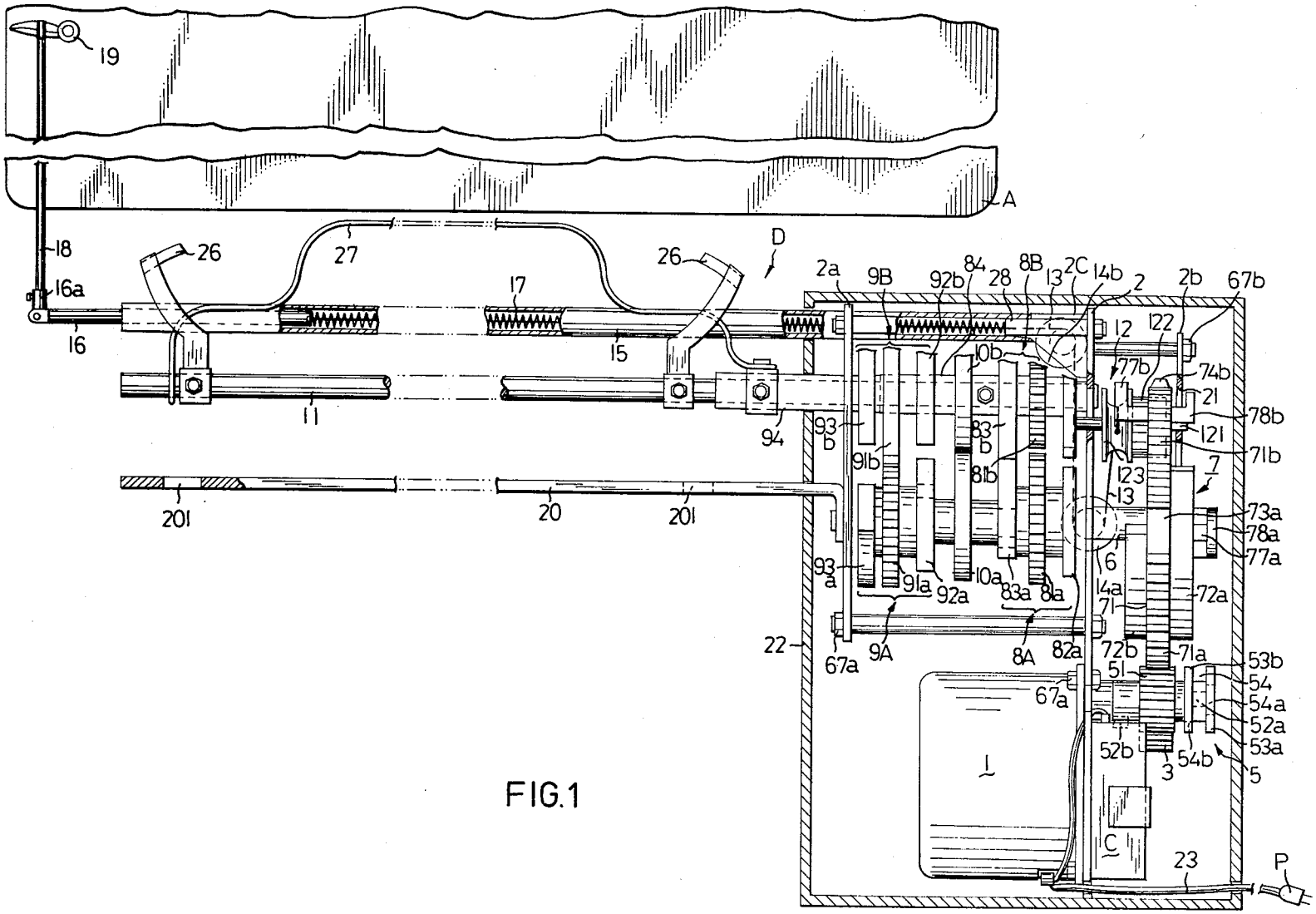
FIG. 1 is a front view of a preferred embodiment of the lid-lifting and flushing device of the present invention in partial cut-away.
Figure 2:
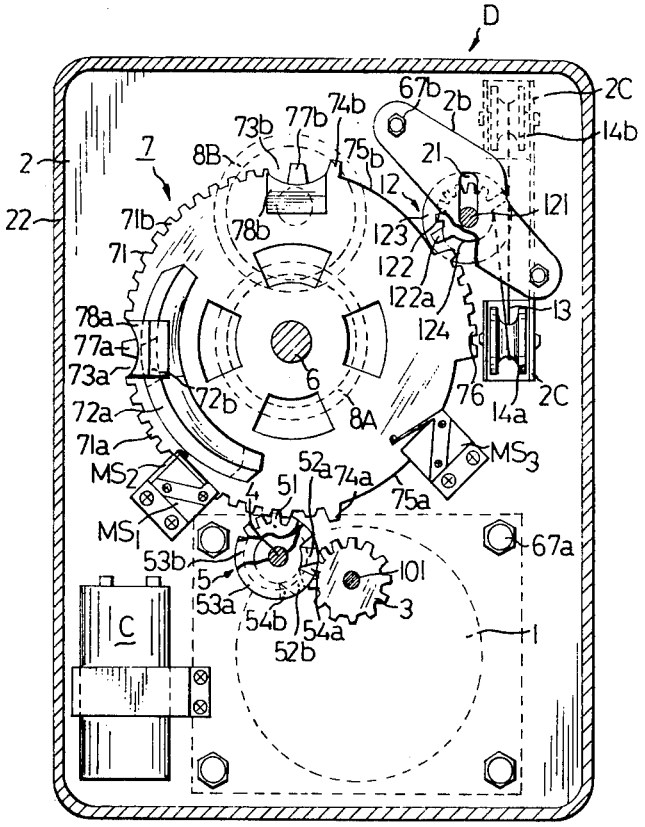
FIG. 2 is a side view of the same embodiment in partial cut-away.

Now referring to FIGS. 1 and 2, the electrically operated lidlifting and flushing device according to the present invention comprises, fixed on lower left side of a main plate 2, a motor 1 of reduced speed. Motor shaft 101 of the low speed motor is protruded at the right side of plate 2, with a driving gear 3 being mounted on the shaft. Above the shaft 101, also protruded at the right side of plate 2, is a shaft 4 which is rotatably mounted on the plate 2. Upon shaft 4, a main driving gear-cam set 5 is mounted. Gear portion 51 of the gear-cam set 5 is meshed with driving gear 3. On the upper portion of plate 2, a shaft 6 is rotatably mounted with its one end protruded at the right side of the plate 2 and its other end supported on an auxiliary plate 2*a* which is fixed by bolts 67*a* on the main plate 2. A big gear-cam or the driven gear-cam set 7 is mounted on the right end of the shaft 6. Gear portion 71 of the set 7 is in mesh with the gear portion 51 of the driving gear-cam set 5. In the meantime, cam portions of sets 5 and 7 have an associated relationship which shall be detailed later.

On the abovesaid shaft 6, at a position between plates 2 and 2*a*, are mounted, from right to left, a transmission gear set 8A, a metal wheel 10*a* and another transmission gear set 9A. Gear set 8A is the driving gear set for seat ring operation; gear set 9A is the driving gear set for lid operation; while the wheel 10*a* is a stablizer. Both gear sets 7A, 9A and the wheels 10*a* rotate with the shaft 6. A center shaft 11 in parallel with the shaft 6 is mounted with one end supported on plate 2 and the other end passing through plate 2*a* and extended toward the left. On the shaft 11 is mounted a driven gear set 8B which is meshed with the abovesaid driving gear set 8A. When gear set 8B is driven, the shaft 11 rotates in the meantime. On the left end of the hollow hub 84 of the gear set 8B, is rotatably mounted a driven gear set 9B which is meshed with the abovesaid driving gear set 9A. Gear set 9B further has a hollow hub 94 extended toward the left with shaft 11 and being rotatable thereon. When gear set 9A rotates, the said set 9B rotates on shaft 11 and around the hollow hub 84. At a position between gear sets 8B and 9B and on the hub 84, a plastic or rubber wheel 10*b* is loosely fitted thereon, which is to be engaged with the metal wheel 10*a*. The movement relationship between 8A, 8B and 9A, 9B shall be detailed later.

A string pulley retaining plate 2*b* is fixed with bolts 67*b* on the main plate 2 (FIG. 2). Slots 21—21 are provided both on the plate 2*b* and on the corresponding location on the plate 2 for resting of the two protruded shaft ends 121—121 of the pulley-cam assembly 12 for flushing. The gear portion 122 of the said assembly 12 is meshed with gear portion of the big gear-cam 7. One end of a pull string 13 is fixed on the pulley portion 123 of the pulley-cam assembly 12, while the other end of the string 13 is turned around a lower guide pulley 14*a* and an upper guide pulley 14*b* which are mounted on a plate 2*c*. Then the said other end of the string 13 is led through a sleeve 28 on plate 2*c* into a long tube 15 which is in parallel with the shaft 11. The said other end of string 13 is tied to an inner end of an actuating rod 16 which is inserted in the long tube 15 and slidable freely therein. Between sleeve 28 and the rod 16, a spring 17 is provided inside the tube 15 and surrounding the string 13. When pulley assembly 12 is driven by gear 7 and rotates counter-clockwisely, the string 13 is wound up against the spring 17 and pulling rod 16 is pulled into the tube 15, until the pulley assembly 12 unmeshes with gear 7, at which time the rod 16 would resume its original position under the force of spring 17. A knuckle joint 16*a* has one end pivoted to the outer end of rod 16 and the other end fixed to a link 18 which link is extended upwardly along the side of a water tank A with the upper end of the link connected to the flushing handle 19.

An anchoring plate 20 which is located under and parallel with the shaft 11, extends leftward from the plate 2*a* for fixing the whole device D to the water closet. Slots 201—201 are disposed on plate 20. Bolts 202—202, ordinarily provided to fix the seat ring and the lid of the water closet, can be utilized to pass through slots 201—201 for anchorings as referred also in FIG. 7.

Figure 7:
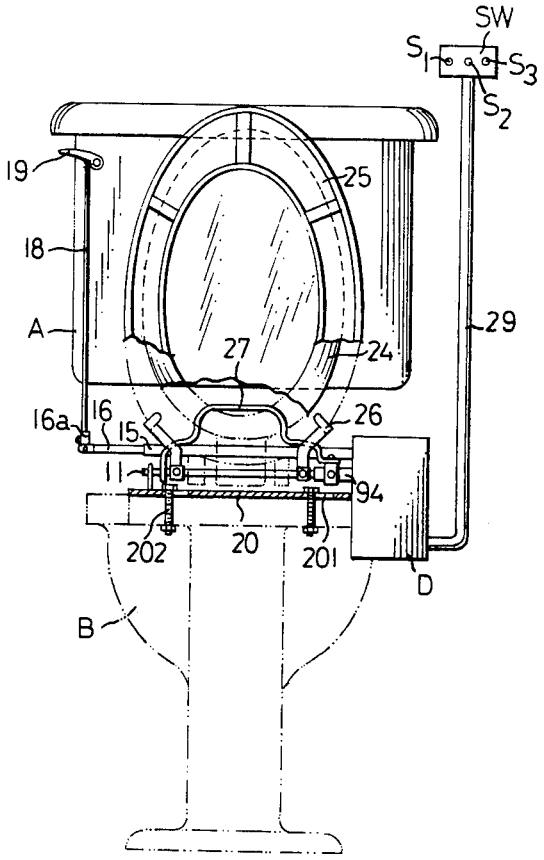
FIG. 7 is a front view showing the set-up of the present device.

Under the left lower side of the big gear-cam 7, on the plate 2, two micro-switches $MS_1$ and $MS_2$ are stacked up which are actuated by the cam portions 72*a* and 72*b* of the gear-cam 7 (FIG. 2). Another microswitch $MS_3$ is disposed at the lower right side of the gear-cam 7 which switch $MS_3$ is associated with the cam portion 72*a*. A condenser C is provided with a fixing strap at the lower left of the plate 2. In the figures, the casing of the device is denoted by 22; 23 being the electric wire leading to the power source; 24 the lid; 25 the seat ring; SW the operating switch, $S_1$ being the switch button for the lid and seat ring, $S_2$ for lid only; $S_3$ for seat ring only; P being a plug for power source (see: FIG. 7 also).

All the electric components including the motor 1, micro-switches $MS_1$, $MS_2$, $MS_3$, operating switch S, and condenser C etc. shall be detailed in function later.

Furthermore, a pair of retaining arms 26 are provided on shaft 11 for supporting and operating the seat ring 25 (FIGS. 1 and 2). On hollow hub 94, one end of a bracket 27 is provided for supporting and operating the lid 24; another end of the bracket 27, is rotatably mounted on the left end of the shaft 11.

Figure 3A:
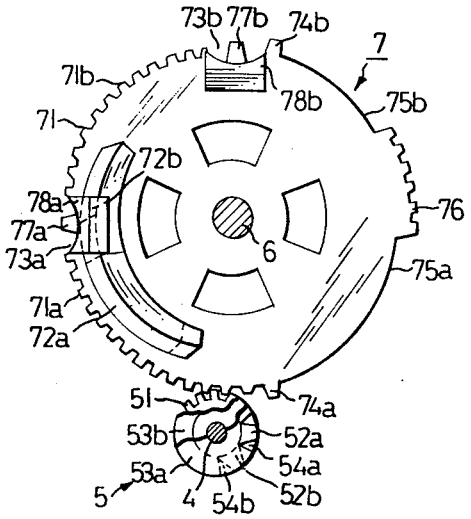
FIG. 3 (A) and (B) are front and side views showing the assembly of cam sets and their relationship of engagement.
Figure 3B:
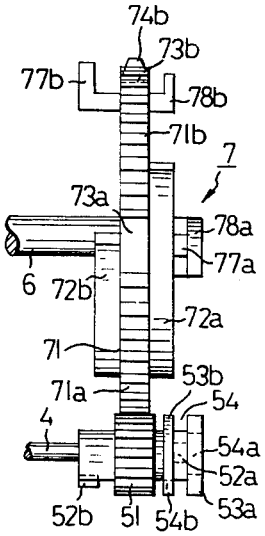

FIG. 3 shows the relationship between the big gear-cam set 7 and the small gear-cam set 5. The big gear-cam set 7 has discontinuous gear portion 71 which is meshed with continuous gear portion 51 of the small gear-cam set 5. Gear portion 71 is further separated into sections 71*a* and 71*b*. Between gear sections 71*a* and 71*b* and also at the end of the section 71*b*, are provided with a recesses 73*a* and 73*b* respectively. Beyond the beginning end of gear section 71*a* and the finishing end of the recess 73*b* are teeth 74*a*, 74*b*. Each tooth 74*a*, 74*b*, having higher addendum, is disposed respectively to serve as a stopper to limit the rotating angle of the gear-cam 7. Between stopper-teeth 74*a* and 74*b* are disposed two toothless sections 75*a* and 75*b* with another gear section 76 in-between them. The gear section 76, having a higher elevation relative to gear sections 71*a* and 71*b*, would mesh with the gear portion 122 of the pulley-cam assembly 12 when the gear-cam set 7 rotates. Between gear sections 71*a* and 71*b*, cam portions 72*a* and 72*b* are disposed at various sides of the set 7 to be engaged with micro-switches $MS_1$ and $MS_2$. At positions corresponding to recesses 73*a* and 73*b*, on the various sides of the gear-cam 7, teeth 77*a* and 77*b* are disposed. At the same positions yet opposite to teeth 77*a* and 77*b*, arc plates 78*a*, 78*b*, disposed to limit the rotation angle of the big gear-cam set 7.

The small gear-cam set 5 has gear portion 51 to mesh with gear section 71 of gear-cam set 7 and the driving gear 3. At front and rear sides of the gear 51, cams 52*a*, 52*b* are so disposed as to engage with said teeth 77*a* and 77*b* respectively. A pair of guide wheels 53*a* and 53*b* are disposed to sandwich the cam 52*a* inbetween, with notches 54*a* and 54*b* provided thereon at the corresponding position of cam 52*a* and 52*b* to avoid conflicting with the respective arc positioning plate 78*a*, 78*b*. In the meantime, the groove 54 between guide wheels 53*a* and 53*b* provides a path way for tooth 77*a* when in idle rotating.

Figure 5:
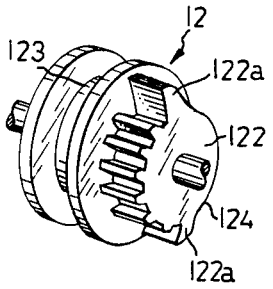
FIG. 5 is a perspective view showing the pulley assembly for flushing.

In FIG. 5, it can be seen that the flashing string pulley-cam assembly comprises a pulley portion 123 and a gear portion 122, being floatingly rested at the lower end of slot 21 on plate 2*b* (see. FIG. 2). The gear portion 122 has a toothless section 124 extended from the gear section, and two teeth 122*a* each with higher addendum, disposed at the beginning and finishing bowndaries of the toothless section. The pulley portion 123 has a groove 123', with one end of pull string 13 being anchored therein (see. FIG. 1).

Figure 4A:
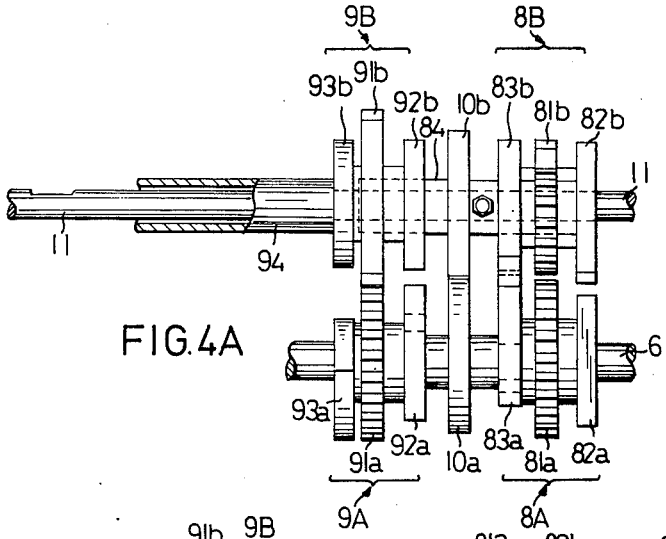
FIG. 4 (A), (B) and (C) are a front view and side views showing relationships of the drive-driven gear sets respectively for lid and seat ring operation.
Figure 4B:
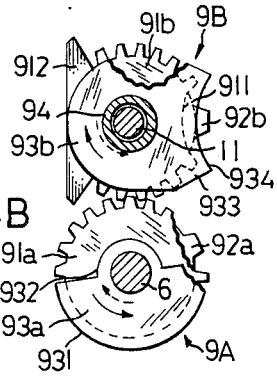
Figure 4C:
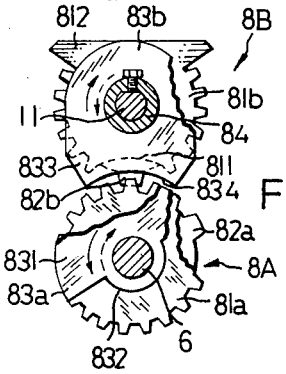

FIG. 4 (A) thru (C) depict the relationship between drive-driven gear sets 8A and 8B for seat ring transmission and the relationship between drive-driven gear sets 9A and 9B for lid-lift transmission. Drive gear set 8A comprises a gear 81*a*, a single toothed gear 82*a* and a cam 83*a* having fan sector 831 and a depressed half circle 832. Driven gear 8B comprises a gear 81*b* having a concave arc 811 and two projections 812, a singled toothed gear 82*b* and a cam 83*b* having a concave arc 834 between two projections 833. The said gears 81*a*, 82*a* and cam 83*a* are associated respectively with gears 81*b*, 82*b* and cam 83*b*.

Drive gear set 9A, in a likewise manner as set 8A, comprises a gear 91*a*, a single toothed gear 92*a* and a cam 93*a* having fan sector 931 and a depresed half circle 932. Driven gear set 9B, like set 8B, comprises a gear 91*b* having a concave arc 911 and two projections 812, a single toothed gear 92*b* and a cam 93*b* having a concave arc 934 between projections 933. The abovesaid gears 91*a*, 92*a* and cam 93*a* are associated respectively with gears 91*b*, 92*b* and cam 93*b*.

Figure 6:
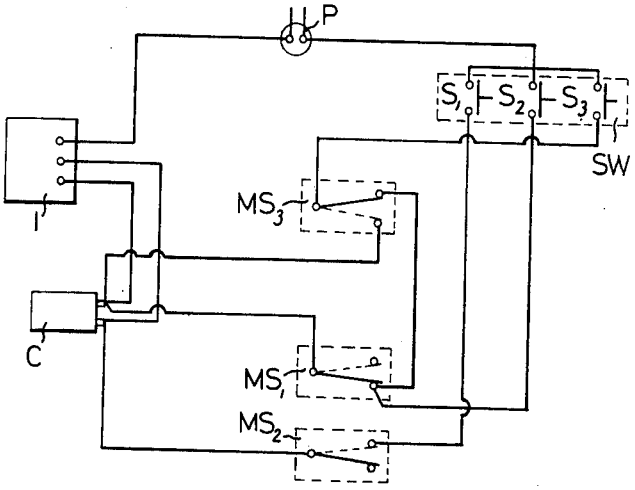
FIG. 6 is a circuit diagram of the device of the present invention.

FIG. 6 depicts the circuit diagram of the device of the present invention having motor 1, condenser C, micro-switches $MS_1$, $MS_2$ and $MS_3$, operating switch SW comprising three push buttons $S_1$, $S_2$ and $S_3$, and a plug P lead to the electric source.

Installation, function and the operation of the said device are detailed hereunder: FIG. 7 depicts the installation. The whole device D is fixed to the rear side of the water closet B by anchoring plate 20 with bolts 202—202 ordinary provided to fix the seat ring and the lid. Lid 24 and seat ring 25 are rotatably mounted on shaft 11, and supported by supporting brackets 27 and retaining arms 26. Operating switch SW can be provided on top of conduit 29 erected upward from the casing 22 of the device D or directly disposed on the wall.

Figure 8:
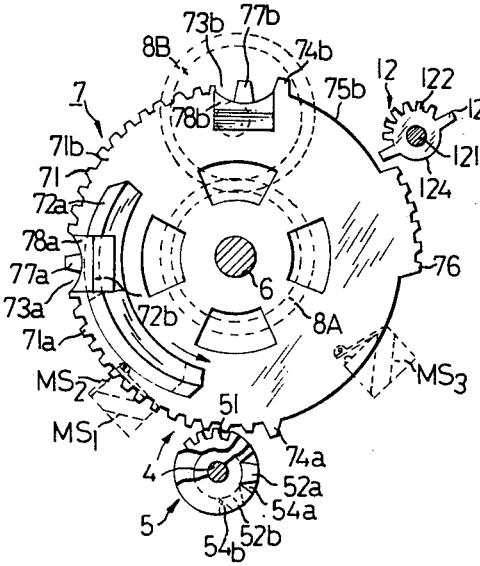
FIGS. 8, 9 and 10 show respectively the functions of the transmission means under different conditions, accompanied with corresponding circuit diagrams.
Figure 8:
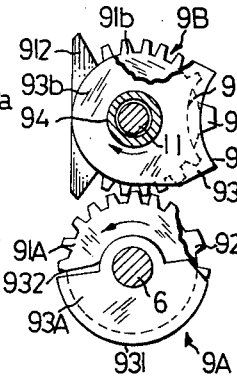
Figure 8:
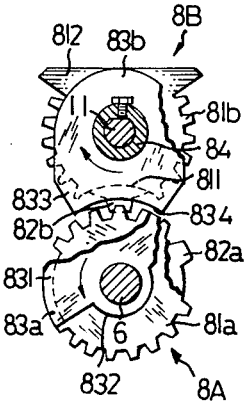
Figure 8:
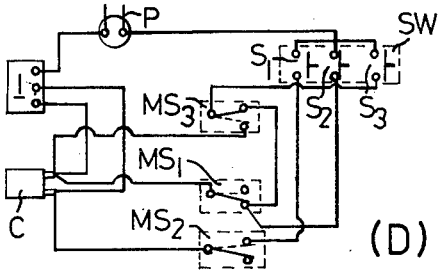

When the device is in inactive condition, the lid 24 and seat ring are both closed. Refer to FIG. 8 (A) to see the relationship between the small gear 51 and the big gear 71. The small gear 51 is meshed with the beginning end of the big gear 71, while cams 72*a* and 72*b* engage respectively with micro-switch $MS_1$ and $MS_2$ which are both in closed condition. When button $S_2$ of SW is pressed, from FIG. 8 (D), it can be seen that a closed circuit is formed by source P, switch SW, micro-switch $MS_1$, condenser C, and motor 1, whereby motor 1 drives gear 3 to cause the small gear-cam set 5 to rotate clockwise. Small gear 51 meshes with gear section 71*a* to drive the big gear-cam set 7 to rotate counter-clockwise. In the meantime, the drive gear set 8A and 9A which are mounted on the same shaft 6 rotate. Referring to FIG. 8 (B) and FIG. 8 (C), since the gear 81*a* of the drive gear set 8A is being faced with the concave arc 811 of gear 81*b* and not meshed up, and in the sametime gear 82*a* and gear 82*b,* cam 83*a* and cam 83*b* are also not meshed, therefore the gear set 8B would not rotate. Shaft 11 is static, and the seat ring 25 remains closed. Yet gear 91*a* of drive gear set 9A meshes with gear 91*b* of driven gear set 9B which would in turn be driven to rotate clockwise. Thus, lid 24 would be lifted through bracket 27 which is mounted on the hollow hub 94 of the driven gear set 9B. In the meantime, the concave arc 911 of gear 91*b* becomes faced with gear 91*a,* and single toothed gear 92*b* becomes engaged with single toothed gear 92*a* as shown in FIG. 9B. On the other hand, when gear 7 rotates gear portion 76 would get in touch with the toothless section 124 of gear portion 122 of pulley-cam assembly 12. Since the said assembly 12 rests in slot 21 and is capable of moving up-down along the slot 21 of plate 2*b,* gear 76 would not be hampered from passing through, but rubs along toothless section 124 and causes the upward movement of the assembly 12 which would not rotate. Gear-cam set 7 keeps on rotating.

When small gear-cam set 5 revolves to more than one turn and drives the big gear cam set 7 to revolve more than 90°, the lid 24 is fully opened. By then, the recess 73*a* is facing small gear 51. In the meantime, the tooth 77*a* with limiting plate 78A comes to the same position, and the micro-switches $MS_1$ and $MS_2$ disengaged from cams 72*a* and 72*b,* and micro-switch $MS_3$ engages with cam 72*a* (see FIG. 9A). With $MS_1$ is in "off" condition, motor 1 stops running because of breaking up of the circuit. In other words, after the lid 24 being lifted up, the transmission stops, and the seat ring 25 is ready to be sat on.

Figure 9:
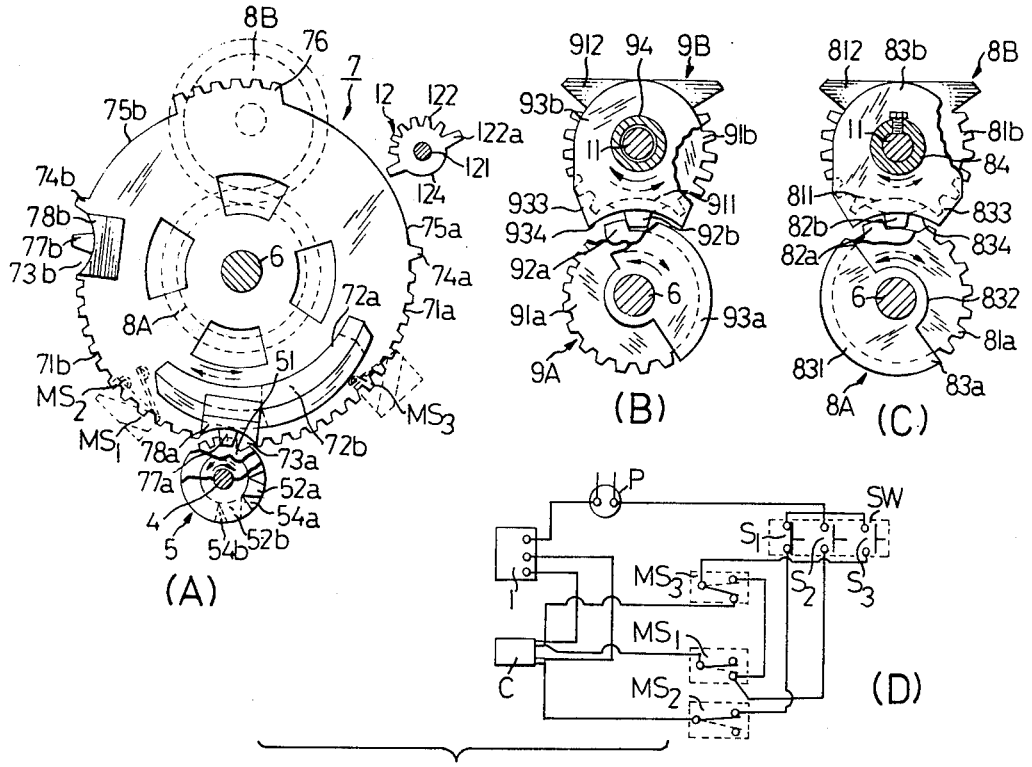

After use, the user stands up from seated position, presses button $S_1$ of SW, a reversing circuit is closed including source P, button $S_1$ of SW, micro-switch $SW_2$, condenser C, and motor 1. (Re. FIG. 9 (D)) Motor 1 rotates in a reversed direction, then the small gear-cam set 5 rotates counter-clockwise through the transmission of gear 3. From FIG. 9 (A), it is shown that the tooth of cam 52*a* will become engaged with tooth 77*a* of the big gear-cam set 7 and forcing the latter to rotate clockwise. When the cam 52*a* pushes away tooth 77*a,* recess 73*a* leaves the facing position with small gear 51. In the meantime, gear section 71*a* again meshes with gear 51; gear-cam set 7 continues to rotate; and drive gear set 8A and 9A in turn rotate accordingly. Referring to FIG. 9B, singled toothed gear 92*a* drives singled toothed gear 92*b* and gears 91*b,* 93*b* formed therewith to rotate through an angle until they are unmeshed. Then the concave arc 911 of gear 91*b* would be forced to leave its position and cause the teeth of gear 91B to mesh with gear 91*a* which in turn drives gear 91*b* to rotate counter-clockwise with the hollow hub 94. The bracket 27 thereon would closed the lid accordingly.

When the small gear-cam set 5 rotates counter-clockwise to about one turn and drives the big gear-cam set 7 to about 90°, the lid 24 is fully closed. By then, micro-switch $MS_2$ is opened by cam 72*b* and thereby breaks the motor circuit. In the meantime, the stopper tooth 74*a* engages with the small gear 51 to prevent the big gear-cam set 7 from continuous rotating. The whole device comes to a standstill, and resumes its ordinary condition. During the rotating of gear-cam set 7, gear section 76 first touches the tooth 122*a* of gear portion 122 of the pulley-cam assembly 12 for flushing string and forces down the gear 122 into meshing engagement. The pulley 123 revolves conter-clockwise and winds up the string 13, causing the rod 16 to retract inside the tube 15 against the force of spring 17. Then the handle 19 of flash tank A is pulled down by rod 16 through knuckle joint 16*a* and link 18 to effect automatic flushing. When gear section 76 leaves gear 122, the handle 19 is restored to its original position by the force of spring 17.

The stablizing wheels 10*a* and 10*b* are in contact with each other and revolve under friction when the lid 24 is being opened or closed. The stablizers serve to prevent the lid from collision with the flush tank or the flush stand or bowl at the end of journey due to inertia or gravity.

If the water closet is desired to be used as man's urinal, then after pressing button $S_2$ press also the button $S_3$ of SW. In such a case, after changing the condition as shown in FIG. 8 to that of FIG. 9, wherein the lid is raised, as caused by depression of the button $S_2$, as discussed earlier a circuit including source P, button $S_3$ of SW, micro-switch $MS_3$, condenser C, motor 1 is still closed. Then the small gear-cam set 5 continues to rotate clockwise from the position of FIG. 9A. Cam 52*a* then gets into contact with tooth 77*a* and forces the big gear-cam set 7 to revolve through a small angle, letting recess 73*a* leave a position facing small gear 51. Gear section 71*b* meshes with small gear 51, so that gear-cam set 7 is driven by gear-cam set 5. Drive gear sets 8A and 9A rotate accordingly. Referring to FIG. 9, cam 72*a* leaves micro-switch $MS_2$, yet presses micro-switch $MS_3$ until the small gear 51 revolves to more than one turn and drives big gear-cam set 7 to about 90° $MS_3$ leaves cam 72*a.* In the meantime, stopper tooth 74*b* gets in touch with small gear 51, then the motor and whole device come to a standstill.

Figure 10:
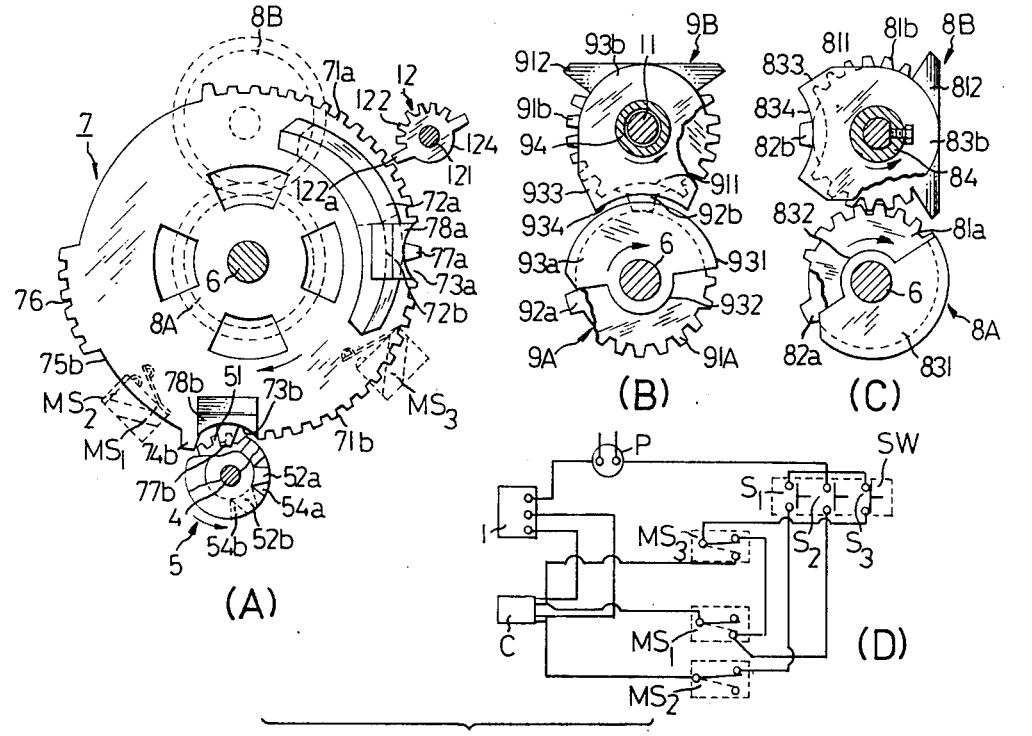

When the big gear-cam set rotates, the single toothed gear 82*a* drives the single toothed gear 82*b* and in turn causes the mesh up of gear 81*b* with gear 81*a* and turns the shaft 11. The seat ring supported on retaining arms 26 is thereby lifted up. As the gear 91*a* is not meshed with gear 92*a* by then, gear 92*b* is in a standstill, as is the hollow hub 94. The lid 24 would thus maintain its opened position. Only gear 91*a* revolves idly under the concave arc 921 of gear 92*a,* until the big gear-cam 7 stops revolving. Drive and driven gear sets 9A and 9B stop in the sametime. On the other hand, during revolving of big gear-cam set 7, the gear section 71*a* was not in mesh with gear 122 of pulley-cam assembly 12, so the assembly would not turn, hence the flushing mechanism would not operate. When gear-cam set 7 stops, cam 72*a* and 72*b* have disengaged from micro-switches $MS_1$, $MS_2$ and $MS_3$, and the circuit diagram becomes as shown in FIG. 10 (D). After the seat ring 25 is lifted up, the water closet is suitable for use as man's urinal with no fear of wetting of the seat ring 25.

After using, the user presses button $S_1$ of SW. A reversing circuit is closed including source P, -button $S_1$ of SW, micro-switch $MS_2$, condenser C, and motor 1, causing the small gear-cam set 5 to rotate reversely through transmission of gear 3. Gear-cam set 7 would revolve through an angle clockwise through meshing of cam 52*b* and tooth 77*b.* After mesh-up of gear section 71*b* and small gear 51, big gear-cam 7 is driven by small gear 51 and continues to rotate, until gear-cam set 7 revolves about 90°. Concave arc 73*a* again comes to a position facing small gear 51. Gear-cam set 7 stops temporarily, yet the small gear-cam set 5 continues to rotate with motor 1. When the gear-cam set 7 changes from the condition shown in FIG. 10 to FIG. 9, the drive gear set 8A, through meshing of gear 81*a* with gear 82*a,* drives the driven gear set 8B to rotate counter clockwise. The seat ring 25 closes with the turning of shaft 11, until the gear-cam set rotates another 90° and stops temporarily; the seat ring 25 being fully closed. At this time, since the drive gear 91*a* of set 9A is not in mesh with gear 91*b* of gear set 9B, the lid 24 would stay unmoved.

But when the motor continues to drive the gear-cam set 5 until cam 52*a* meshed with tooth 77*a* once again, the concave arc 73*a* leaves the small gear-cam set 5 first, then gear section 71*a* comes to mesh with small gear 51. Big gear-cam set 7 begins to revolve again. When gear-cam set 7 revolves clockwise, gear section 76 meshes with gear 122 of the pulley-cam assembly 12. Pulley 123, in turn, winds up the string 13 to effect automatic flushing like aforementioned. The actions of drive gear sets 8A, 9A and the driven gear sets 8B, 9B are just the same as in the case of closing lid 24 and shall no more be detailed. When the gear-cam 7 continues to rotate another 90° to resume the position as shown in FIG. 8, as the micro-switch $MS_2$ is opened, motor 1 stops. The whole device comes to a standstill.

When the lid 24 and seat ring are being closed as aforesaid, guide wheels 53*a* and 53*b* attached to small gear-cam set 5, incorporated with limiting plates 78*a* and 78*b,* and cams 83*a,* 83*b* of gear sets 8A, 8B incorporated with gears 93*a,* 93*b* of gear sets 9A, 9B, assure a smooth operation by guiding a proper position of mesh-up between gears 77*a,* 77*b* with cams 52*a,* 52*b,* and gears 82*a,* 92*a* with gears 82*b,* 92*b.*

With the mechanism as abovesaid, the lifting and closing of lid and seat ring of a water closet and the automatic flushing after closing of lid can be easily achieved simply by a push of a button. It is so convenient and clean. Also, the said device can be adapted to any existing water closet and sold as an individual commodity item.

We claim:

1. A control mechanism in combination with a water closet having a bowl, a flush tank, a raisable and closable lid, a raisable and closable seat and a flushing mechanism, said control mechanism being operable to automatically control the raising and lowering movements of said lid and seat as well as the actuation of said flushing mechanism, said control mechanism comprising:

a casing;

a low speed motor mounted in said casing;

motor actuated means operably connected to be driven by said motor;

lid operating means interconnecting said motor-actuated means and said lid for raising and lowering said lid;

seat operating means interconnecting said motor-actuated means and said seat for raising and lowering said seat;

electric control means electrically connected to said motor, said electric control means comprising:

a first manually operable switch for actuating said motor and said motor-actuated means through a lid-raising sequence in which said lid operating means raises said lid;

a second manually operable switch for actuating said motor and said motor-actuated means through a seat-raising sequence in which said seat operating means raises the seat; and a third manually operable switch for actuating said motor and said motor-actuated means in reverse for closing said seat if the latter is raised and for closing said lid; and flush operating means interconnecting said flashing mechanism and said motor-actuated means and being driven by the latter only during said reverse actuation thereof in response to operation of said third switch, to flush said bowl.

2. A control mechanism according to claim 1 wherein:

a mounting plate is connected to and extends from said casing for mounting said casing to the water closet;

said motor actuated means comprises:

a small drive gear-cam set driven by said motor and including a drive gear section and a plurality of drive cam sections rotatable with said drive gear section;

a big driven gear-cam set fixedly mounted on a first shaft and being arranged so as to be rotated through selected angles by said small drive gear-cam set, said big driven gear-cam set including:

a driven gear section having discontinuous portions and first and second toothed portions arranged to be rotated by said drive gear section;

a plurality of cam sections; and a plurality of tooth sections arranged to be driven by said drive cam sections when said drive gear faces said discontinuous portions of said driven gear;

said lid operating means comprising:

a first driving-gear set mounted on said first shaft so as to be rotatable in response to rotation of said big driven gear-cam set, said first driving-gear set including:

a first drive gear section;

a first single-toothed driving gear section; and a first position-limiting cam section;

a second shaft located above said first shaft and extending parallel thereto, said second shaft projecting beyond said casing;

a hub loosely mounted on said second shaft;

a first driven gear set freely mounted on said second shaft and arranged to be driven by said first driving gear set for lifting and closing the lid, said first driven gear set comprising:

a first driven gear section arranged to be driven by said first drive gear section;

a first single-toothed driven gear section arranged to be driven by said first single-toothed driving gear section; and a first positioning cam section arranged to engage said first position-limiting cam section; and bracket means fixedly mounted to said hub and projecting from said casing, said bracket means being arranged to support the lid for lifting and closing movements;

said seat operating means comprising:

a second driving-gear set mounted on said first shaft so as to be rotatable in response to rotation of said big driven gear-cam set, said second driving-gear set including:

a second drive gear section;

a second single-toothed driving gear section; and a second position-limiting cam section;

a second driven gear set fixedly mounted on said second shaft and arranged to be driven by said second driving gear set for lifting and closing the seat, said second driven gear set including:

a second driven gear section arranged to be driven by said second drive gear section;

a second single-toothed driven gear section arranged to be driven by said second single-toothed driving gear section; and a second positioning cam section arranged to be engaged by said first positioning cam section; and arm means being fixedly mounted to said second shaft and projecting from said casing, said arm means being arranged to support the seat for lifting and closing movements;

a retaining plate is mounted on said casing;

said flush operating means comprising:

a pulley-cam assembly floatingly mounted in said retaining plate, said pulley-cam assembly including a gear section, a cam section rotatable with said gear section, and a pulley section rotatable with said last-named gear section; said pulley-cam assembly being arranged so that the gear section thereof meshes with said driven gear section of said big driven gear-cam set to be rotated thereby when the latter rotates in one direction during a lid closing operation, said gear section being out of meshing engagement with said driven gear section when the latter rotates in the opposite direction during lid and seat lifting operations;

linkage connected to said flushing mechanism;

a spring connected to said linkage to bias the latter to a non-flush position; and a flushing string having one end connected to said pulley section so as to be wound-up thereon when said pulley section is rotated by said big driven gear-cam set, and the other end thereof being connected to said linkage so as to move said linkage to a flush-initiating position when said string is wound-up on said pulley section as said lid is being closed.

3. A control mechanism according to claim 2 including: a plurality of microswitches positioned for engagement with said cam sections of said big driven gear-cam set to de-energize said motor in response to completion of the action initiated by said switch means.

4. A control mechanism according to claim 2 including:

a first stabilizing wheel mounted on said first shaft; and a second stablizing wheel mounted on said second shaft;

said first and second stabilizing wheels being configured so as to be in frictional driving engagement when the lid is being lifted or closed to prevent the lid from colliding with the flush tank or bowl.

5. The device according to claim 2, wherein said small drive gear-cam set further comprises a first guide wheel disposed adjacent to the outer side of said drive gear section and having a notch thereon, one of said drive cam sections being disposed adjacent the inner side of said drive gear section and having a tooth projected corresponding to the notch of the first guide wheel, the other of said drive cam sections being disposed adjacent to the outer side of said first guide wheel and having a tooth projected adjacent to the notch of the first guide wheel; and a second guide wheel located adjacent to the said other of said drive cam sections and having a notch located corresponding to the projected tooth of said other drive cam section.

6. The device according to claim 2, wherein said tooth portions of said big driven gear-cam sets occupy about one-half of the circumference of said driven gear section, one of said discontinuous portions being located centrally intermediate said toothed portions such that each toothed portion occupies about one-quarter of the periphery of said driven gear section; the other of said discontinuous portions being disposed at the finishing end of said second toothed section corresponding to the end of a seat-lifting operation; each toothed section including a stopper tooth having a higher addendum than the remaining teeth and being disposed respectively at the beginning end of said first toothed section and at the finishing end of said second toothed section to limit the rotating angle of the big driven gear-cam set; between said stopper-tooth members there being disposed a pair of toothless portions separated by a gear portion, the last-named gear portion having a higher elevation than the first and second toothed portions; said last-named gear portion being operable to mesh with said gear section of said pulley-cam assembly to rotate the latter to wind-up said flushing string; said tooth sections of said big driven gear-cam set being disposed respectively at opposite sides of said driven gear section in alignment with said discontinuous portion; a pair of arc-shaped plates being disposed on said driven gear section in alignment with said discontinuous portions to limit the rotational position of said driven gear section and permit travel of said drive cam sections of said small drive gear-cam set when in engagement with said tooth sections.

7. A device according to claim 2 wherein said pulley-cam assembly comprises a gear wheel carrying said gear section and said cam section, the former occupying about one-half of said gear wheel, said pulley section comprising a pulley wheel formed integrally with said gear wheel; said mounting plate having a vertical slot receiving said pulley-cam assembly; said flushing string being anchored in a groove of said pulley wheel; a plurality of guide pulleys being provided, with said string being wrapped therearound to guide said string toward its connection with said linkage; said driven gear section including a gear portion arranged relative to said pulley-gear assembly so that when said driven gear section rotates in said opposite direction for opening the lid or seat said gear portion displaces said pulley-gear assembly in said slot and the assembly does not rotate, and when said driven gear section rotates in said one direction to close the lid, said gear portion meshes with said gear section of said assembly to wind-up said string.

8. A device according to claim 2 wherein said first and second position-limiting cams of said first and second driving-gear sets includes a fan sector and a semicircular recess; said first and second positioning cam sections being mutually oriented about one hundred eighty degrees out of phase along said first shaft; said first and second single-toothed gear sections being mutually in-phase along said first shaft.

9. A device according to claim 2 wherein said first and second driven gear sections of said first and second driven gear sets each includes a concave arc and two projections; each of said first and second positioning cams including a concave arc between two projections; each driven gear set being arranged so that the arcs of the driven gear sections and the positioning cams are mutually in-phase along said second shaft; and the single tooth of each of said single tooth gears are in-phase with said respective arcs.

10. A device according to claim 2 wherein said second driven gear set includes a sleeve extending toward said first driven gear set and fixed to said second shaft; said hub of said first driven gear set having one end freely rotatably mounted on said sleeve and another end freely rotatably mounted on said second shaft.

11. A device according to claim 2 wherein said single toothed gears of said first and second driven gear sets are disposed ninety degrees out-of-phase on said second shaft; in a condition where said lid and seat are both closed, the tooth of said second single toothed driven gear being oriented vertically downwardly.

* * * * *